US006411792B2

(12) United States Patent
Hirai

(10) Patent No.: US 6,411,792 B2
(45) Date of Patent: Jun. 25, 2002

(54) IMAGE FORMING DEVICE

(75) Inventor: Masashi Hirai, Katano (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/784,043

(22) Filed: Feb. 16, 2001

(30) Foreign Application Priority Data

Feb. 17, 2000 (JP) ..... 2000-039169

(51) Int. Cl.[7] ..... G03G 15/16; G03G 15/01
(52) U.S. Cl. ..... 399/299
(58) Field of Search ..... 399/299, 298, 399/297, 303, 313, 318

(56) References Cited

U.S. PATENT DOCUMENTS 5,655,173 A 8/1997 Masashi et al. ..... 399/21
5,678,150 A * 10/1997 Takahashi et al. ..... 399/299

FOREIGN PATENT DOCUMENTS

| | | |
|---|---|---|
| JP | 63-301084 | * 12/1988 |
| JP | 04022980 | 1/1992 |
| JP | 11-344877 | * 12/1999 |

* cited by examiner

*Primary Examiner*—Sophia S. Chen

(57) ABSTRACT

The present invention includes: image carriers provided parallel to each other in a transfer area where toner images are transferred to a transfer medium; and transfer rollers, each being associated to a different one of the image carriers, for transferring the toner images carried by the image carriers to the transfer medium, wherein: the transfer rollers are fabricated in a crown shape and so that the crown quantities of the crown shapes of the transfer rollers decrease in stages towards a downstream side along the transport direction of the transfer medium.

7 Claims, 4 Drawing Sheets

$\Delta diameter_{29a} = B - A$ or $B - C$, wherein
$\Delta diameter_{29a} > \Delta diameter_{29b} > \Delta diameter_{29c} > \Delta diameter_{29d}$, and
$\Delta diameter_{29d} = 0$ $\Delta diameter_{29a} = B - A$ or $B - C$, wherein
$\Delta diameter_{29a} > \Delta diameter_{29b}$
$\Delta diameter_{29a} > \Delta diameter_{29c}$
$\Delta diameter_{29a} > \Delta diameter_{29d}$, and
$\Delta diameter_{29b} = \Delta diameter_{29c} = \Delta diameter_{29d} = 0$ $\Delta diameter_{29a} = B - A$ or $B - C$, wherein $\Delta diameter_{29a} > \Delta diameter_{29b} > \Delta diameter_{29c} > \Delta diameter_{29d}$, and $\Delta diameter_{29d} = 0$ $\Delta diameter_{29a} = B - A$ or $B - C$, wherein $\Delta diameter_{29a} > \Delta diameter_{29b}$ $\Delta diameter_{29a} > \Delta diameter_{29c}$ $\Delta diameter_{29a} > \Delta diameter_{29d}$, and $\Delta diameter_{29b} = \Delta diameter_{29c} = \Delta diameter_{29d} = 0$

IMAGE FORMING DEVICE

FIELD OF THE INVENTION

The present invention relates to an image forming device incorporating image carriers for carrying toner images on their surfaces and transfer rollers for pressing a transfer medium against the image carriers to transfer the toner images carried by the image carriers to the transfer medium, and particularly to transfer roller used in such an image forming device.

BACKGROUND OF THE INVENTION

Conventionally, in an image forming device incorporating an image carrier for carrying a toner image on its surface and a transfer roller for pressing the toner image carried by the image carrier against a transfer medium to transfer the toner image to the transfer medium, the surface of the transfer roller is made of elastic material, and the roller is fabricated in a so-called straight shape so that the diameter of a cross section taken at right angles to the axis is uniform over the entire length of the axis.

If the transfer roller has such a straight shape and the transfer medium is made of paper, such as a sheet of recording paper, partial whitening of the image may develop at the trailing end of the sheet depending on relationship between the direction of the fibers in the sheet and the transport direction of the sheet and other factors. The partial whitening at the trailing end of the sheet is likely to occur when the sheet has absorbed moisture in a non-uniform manner and is used in a highly humid environment. Besides, it is particularly likely to occur when the direction of the fibers in the sheet is not aligned with the transport direction of the sheet.

Specifically, if paper sheets as transfer media are stacked in a cassette and left in a highly humid environment for more than 15 hours, those near the bottom of the cassette are exposed to external air at their edges, but no so in the center. As a result, the edges absorb more moisture and grow thicker than the center, which increases the likelihood of partial whitening occurring along the edges. Those sheets that are left stacked near the top of the cassette are exposed to external air both at their edges and in their center and thereby absorb moisture uniformly. As a result, partial whitening at the trailing ends of the sheets is not likely to occur.

In addition, the transfer roller with a straight shape is likely to experience a higher transfer pressure in its axial end portions than in its axial midportion. Consequently, the toner image is not transferred in good conditions at the center of the recording paper, causing partial whitening.

Accordingly, Japanese Laid-Open Patent Application No. 4-22980/1992 (Tokukaihei 4-22980; published on Jan. 27, 1992) discloses a transfer roller of such a shape that the diameter of a cross section taken at right angles to an axis is smallest in the axial end portions and increases towards the axial midportion (hereinafter, will be referred to as a crown shape). Such a crown shape of the transfer roller causes the transfer pressure applied by the transfer roller to the image carrier to be greater in the axial midportion than in the axial end portions. This enables a suitable pressure to be applied to the recording paper sheet which is thicker at its edges than at its center due to non-uniform absorption of moisture at a press position (toner image transfer position) formed by the transfer roller and the image carrier. Thus, the toner image can be effectively transferred to the transfer medium, and partial whitening can be prevented.

Some image forming devices, like those disclosed in the aforementioned Japanese Laid-Open Patent Application, incorporate a pair of a transfer roller and an image carrier, while others incorporate pairs of them. The latter ones are typically called image forming devices of a tandem type.

In an image forming device of a tandem type, more than one image carrier are disposed parallel to one another in a transfer area where the toner image is transferred to a transfer medium, and an individual transfer roller, whose surface is made of elastic material, for pressing the toner image carried by the image carrier against the transfer medium to transfer the image to the transfer medium is provided for each of the image carriers.

The image forming device of a tandem type arranged as above is in some cases still falls short of effectively transferring the toner image to the transfer medium due to the non-uniform absorption of moisture by the transfer medium. To produce a better result in the transfer of the toner image to the transfer medium in an image forming device of a tandem type, one would naturally think of installing transfer rollers of a crown shape explained above.

However, in an image forming device of a tandem type, the transfer positions, i.e., the press sections formed by the image carriers and the transfer rollers, are lined along the transport path of the transfer medium, and toner images are transferred one by one to the transfer medium in associated transfer positions while it is moving along the path. Therefore, the resultant toner image formed on the transfer medium grows thicker as the transfer medium moves downstream along the path.

Accordingly, if those transfer rollers that are lined along the transport path share an identical difference between the diameters of cross sections taken at right angles to an axis in the axial midportion and in the axial end portions (hereinafter, will be referred to as a crown quantity), and the transfer roller located in the most upstream transfer position is adjusted so that it would exert a substantially identical transfer pressure to the image carrier in its axial midportion and in its axial end portions, the remaining transfer rollers, located in relatively downstream positions, exert different transfer pressures in the axial midportion and in the axial end portions due to the thickness of the toner image and fail to transfer the toner image in more stable conditions.

Alternatively, if the transfer roller located in the most downstream transfer position is adjusted so that it would exert a substantially identical transfer pressure to the image carrier in its axial midportion and in its axial end portions, the remaining transfer rollers, located in relatively upstream positions, can only exert an overall transfer pressure that is insufficient due to a smaller thickness of the toner image formed on the transfer medium in those positions than in the most downstream position and fail to transfer to toner image in stable conditions.

Further, due to the shape of the transfer rollers, it is extremely difficult to cause the transfer pressure exerted by the transfer roller in every transfer position to be adjustable along the axis of the transfer roller and thereby enable the transfer roller to exert an identical transfer pressure to the image carrier in its axial midportion and in its axial end portions.

As detailed so far, the transfer rollers of a crown shape, when used in the image forming device of a tandem type, develop unstable transfer conditions either in upstream transfer positions or downstream transfer positions and result in a problem that a satisfactory copy image cannot be formed on the transfer medium.

SUMMARY OF THE INVENTION

The present invention has an object to provide an image forming device capable of forming a clear and vivid copy image on a transfer medium.

To accomplish the object, an image forming device in accordance with the present invention includes:

image carriers provided parallel to each other in a transfer area where toner images are transferred to a transfer medium; and transfer rollers, each being associated to a different one of the image carriers, for pressing and thus transferring the toner images carried by the image carriers to the transfer medium, wherein:

each of the transfer rollers is fabricated in a crown shape and so that a difference between diameters of cross sections taken at right angles to an axis in an axial midportion and in axial end portions decreases in stages towards a downstream side along a transport direction of the transfer medium.

With the arrangement, the transfer rollers fabricated in a crown shape; therefore the transfer pressure exerted by the transfer roller to the image carrier can be prevented from decreasing in the axial midportions of the transfer positions (press sections where the transfer roller press the image carriers). As a result, the transfer pressure exerted to the transfer medium transported to the transfer position can be rendered substantially uniform in the axial midportion and in the axial end portions of the transfer roller.

In addition, the difference between the diameters of cross sections taken at right angles to an axis in the axial midportion and in the axial end portions of the transfer roller, i.e., the crown quantity, decreases in stages along the transport direction of the transfer medium; therefore, the transfer pressure exerted to the image carrier in the axial midportion of the transfer roller can also be caused to decrease in stages along the transport direction of the transfer medium. This allows the transfer pressure on the transfer medium on which the toner layer grows thicker in stages towards the downstream side along the transport direction of the transfer medium to be reduced in stages in the axial midportions of the transfer positions and thereby enables the transfer pressure on the transfer medium in the transfer positions to be substantially uniform in the axial midportion and in the axial end portions of the transfer roller.

As a result, a clear and vivid, well-fixed copy image can be formed on the transfer medium with no partial whitening both in the upstream and downstream transfer positions along the transport direction.

For a fuller understanding of the nature and advantages of the invention, reference should be made to the ensuing detailed description taken in conjunction with the accompanying drawings.

BRIEF DESCRIPTION OF THE DRAWINGS

FIG. 4(*b*) is an explanatory drawing showing a crown shape of a transfer roller for comparison with the present embodiment.

DESCRIPTION OF THE EMBODIMENTS

Figure 2:
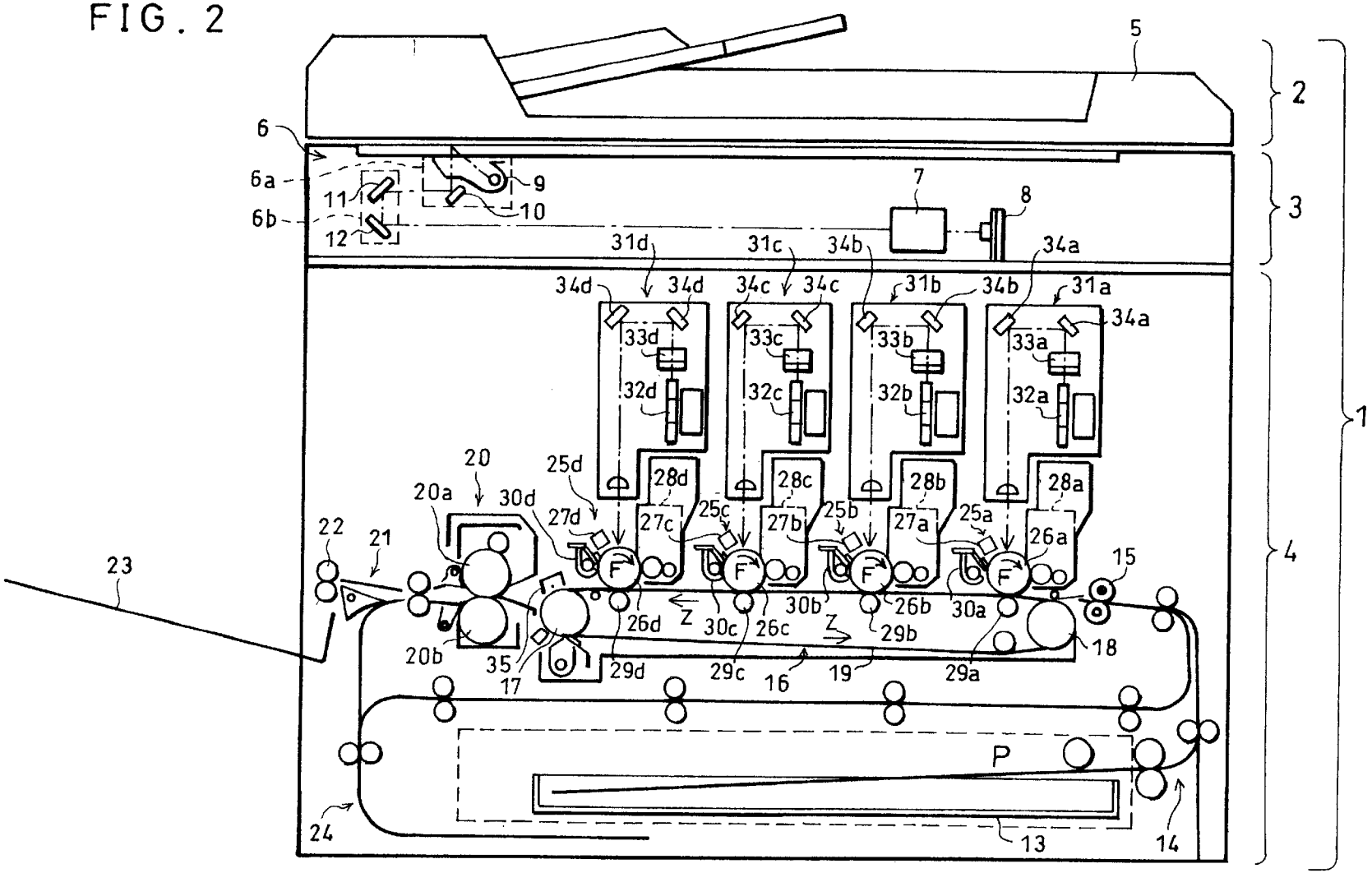
FIG. 2 is a drawing schematically showing an arrangement of an image forming device of an embodiment in accordance with the present invention.

The following will discuss embodiments in accordance with the present invention. A digital color copying machine 1 as an image forming device of the present embodiment, as shown in FIG. 2, includes in it an image reader unit 3 and an image forming unit 4 which are topped by an original document table 2.

The original document table 2 includes an RADF (Recirculating Automatic Document Feeder) 5 on top. The RADF 5 is mounted on the original document table 2 at a predetermined relative position to the original document table 2 so that it can be freely lifted off and placed back on the original document table 2.

In addition, the RADF 5 transports an original document with one of the two sides of the original document facing an image reader unit 3 (detailed later) on a predetermined part of the original document table 2. After the image reader unit 3 has completed reading of an image on that side, the RADF 5 reverses the original document so that the remaining side of the original document would face the image reader unit 3 on a predetermined part on the original document table 2 and transports the original document again towards the original document table 2.

After the reading of the image is completed on both sides of the original document, the RADF 5 ejects this original document and repeats the recirculating operation on a next original document. The transport and reversion processes carried out by the RADF 5 on an original document are controlled in relation to the overall operation of the digital color copying machine 1.

The image reader unit 3 is disposed below the original document table 2 and includes an original document scanner 6, an optical lens 7, and a CCD line sensor 8 which is a photoelectric transducer.

The original document scanner 6 includes a first scan unit 6*a* and a second scan unit 6*b* and reciprocally moves parallel to the bottom plane of the original document table 2.

The first scan unit 6*a* includes an exposure lamp 9 and a first mirror 10 and reciprocally moves parallel to the bottom plane of the original document table 2 at a predetermined scanning speed while keeping a fixed distance from the bottom plane.

The exposure lamp 9 shines a laser beam to the image side of the original document transported by the RADF 5 onto the original document table 2. The first mirror 10 guides in a predetermined direction a reflection image projected by the laser beam which is shone by the exposure lamp 9 and then reflected by the surface of the original document.

The second scan unit 6*b* includes a second mirror 11 and a third mirror 12 and reciprocally moves parallel to the first scan unit 6*a* at a fixed speed relative to the first scan unit 6*a*.

The second mirror 11 guides towards the third mirror 12 the reflection image guided by the first mirror 10 in the first scan unit 6*a*. Further, the third mirror 12 guides in a predetermined direction the reflection image guided by the second mirror 11.

The optical lens 7 is disposed in the path in which the reflection image guided by the third mirror 12 in the second scan unit 6*b* passes. The optical lens 7 scales down the reflection image and focuses it on a predetermined place (detailed later) on the CCD line sensor 8.

The CCD line sensor 8 sequentially converts the focused optical images to output electrical signals. For example, the CCD line sensor 8 can be replaced with a so-called three line color CCD which reads a black and white or color image focused by the optical lens 7, decomposes the image into R (red), G (green), and B (blue) color components, and outputs electrical signals by photoelectrically converting line data.

The image information of the original document, converted by the CCD line sensor 8 and now taking the form of electrical signals, is transmitted to an image processing unit (not shown) where it undergoes predetermined image data processing for color conversion.

As explained above, the image reader unit 3 reads the image on the original document transported by the RADF 5 onto the original document table 2 and transmits the image information of the color-converted, input original document to the image forming unit 4.

Now, the following will explain the arrangement of the image forming unit 4 and associated members.

The image forming unit 4 includes a paper feeder cassette 13, a paper feeder mechanism 14, a resist roller 15, a transfer and transport belt mechanism 16, four identically arranged image formation stations 25*a*, 25*b*, 25*c*, and 25*d*, four identically arranged laser beam scanner units 31*a*, 31*b*, 31*c*, and 31*d*, a discharger 35, a fixer 20, a transport direction switching gate 21, an ejection roller 22, a paper ejection tray 23, and a switch-back transport path 24.

The paper feeder cassette 13, the paper feeder mechanism 14, and the resist roller 15 are disposed below the image forming unit 4. The paper feeder cassette 13 houses sheets P as transfer media. The paper feeder mechanism 14 separates the sheets P housed in the paper feeder cassette 13 into individual sheets and transport each to a predetermined position in the image forming unit 4.

The resist roller 15 is disposed before the image formation stations 25*a* to 25*d*. The resist roller 15 transports the sheets P separated and fed one by one by the paper feeder mechanism 14 to the transfer and transport belt mechanism 16 at controlled timings.

The transfer and transport belt mechanism 16 includes a drive roller 17, a driven roller 18, and a transfer and transport belt 19.

The transfer and transport belt 19 is wound around and supported by the drive roller 17 and the driven roller 18 so that it extends substantially parallel between the two rollers 17 and 18. The transfer and transport belt 19 is driven by the drive roller 17 through friction with it in the direction indicated by arrow Z in FIG. 1, electrostatically attracts the sheet P fed by the paper feeder mechanism 14 via the resist roller 15 as mentioned earlier, and transports the sheet P to the image formation stations 25*a* to 25*d*.

The image formation stations 25*a* to 25*d* and the laser beam scanner units 31*a* to 31*d* form a toner image on one of the two sides of the sheet P. The arrangements and functions of the image formation stations 25*a* to 25*d* and the laser beam scanner units 31*a* to 31*d* will be detailed later.

The discharger 35 is disposed substantially right above the drive roller 17 between the image formation station 25*d* and the fixer 20. The discharger 35 receives an alternating current and separates the sheet P electrostatically attracted onto the transfer and transport belt 19 from the transfer and transport belt 19.

The fixer 20 is disposed downstream to the transfer and transport belt 19 and includes a pair of fixing rollers 20*a* and 20*b*. The toner image transferred onto the sheet P is fixed to the sheet P as it passes through a nip section between the fixing rollers 20*a* and 20*b*. The sheet P with the toner image fixed on it passes through the fixer 20 and transported to the transport direction switching gate 21.

The switching gate 21 selectively switches the transport path for the sheet P with the fixed toner image between the path to eject the sheet P from the digital color copying machine 1 and the path to feed the sheet P back to the image forming unit 4.

If the switching gate 21 has switched the transport path to the path to eject the sheet P from the digital color copying machine 1, the sheet P is ejected by the ejection roller 22 to a paper ejection tray 23 that is attached on the exterior wall of the digital color copying machine 1.

Meanwhile, if the switching gate 21 has switched the transport path to the path to feed the sheet P back to the image forming unit 4, the sheet P is transported to a switch-back transport path 24 where it is reversed and then fed back to the image forming unit 4 by the resist roller 15.

Now, the arrangement and functions of the image formation stations 25*a* to 25*d* are explained in detail. The image formation stations 25*a* to 25*d* are disposed parallel to each other near the transfer and transport belt 19 in this order when viewed from the upstream side of the sheet transport path. Since the image formation stations 25*a* to 25*d* in practice share a common arrangement and functions, the description below will focus on the arrangement and functions of the image formation station 25*a*.

The image formation station 25*a* includes a photosensitive drum 26*a* as an image carrier for carrying a toner image on its surface, a charger 27*a*, a developer 28*a*, a transfer roller 29*a*, and a cleaner 30*a*.

The photosensitive drum 26*a* is driven to rotate in the direction indicated by arrow F in FIG. 2. The charger 27*a* electrically charges the surface of the photosensitive drum 26*a* uniformly.

The developer 28*a* moves the toner stored in it close to the photosensitive drum 26*a* and thus causes the toner to be attracted to a part of the photosensitive drum 26*a* where a laser beam scanner unit 31*a* (detailed later) has formed an electrostatic latent image to visualize the electrostatic latent image as a toner image.

The transfer roller 29*a* transfers the developed toner image from the photosensitive drum 26*a* to the sheet P. The transfer roller 29*a* has a surface made of conducting elastic material, such as a conducting rubber with a hardness ranging about from 28 degrees to 30 degrees in Asker C. Preferred examples of conducting rubber includes urethane and EPDM (ethylene-propylenediene copolymer) rubbers with a dispersed conducting filler, such as carbon or a metal oxide.

The transfer roller 29*a*, permanently pressing the photosensitive drum 26*a* with a predetermined pressure, applies a voltage to the sheet P which has been transported to a press position (transfer position) where the transfer roller 29*a* presses the photosensitive drum 26*a* and transfers the toner image from the photosensitive drum 26*a* to the sheet P by the pressure.

The cleaner 30*a* removes residual toner from surface of the photosensitive drum 26*a*.

In the image formation stations 25*b* to 25*d*, the photosensitive drums 26*b* to 26*d* are equivalent to the photosensitive drum 26*a*, the chargers 27*b* to 27*d* to the charger 27*a*, the developers 28*b*to 28*d*to the developer 28*a*, the cleaners 30*b* to 30*d* to the cleaner 30*a*, and the transfer rollers 29*b* to 29*d* to the transfer roller 29*a*.

The developer 28*a* stores black toner, the developer 28*b* cyan toner, the developer 28*c* magenta toner, and the developer 28*d* yellow toner. The electrostatic latent image on the photosensitive drums 26*a* to 26*d* is developed by the toner of these colors respectively.

Next, the arrangement and functions of the laser beam scanner units 31*a* to 31*d* will be explained in detail. The laser beam scanner unit 31*a* is disposed above the image formation station 25*a*, the laser beam scanner unit 31*b* above the image formation station 25*b*, the laser beam scanner unit 31*c* above the image formation station 25*c*, and the laser beam scanner unit 31*d* above the image formation station 25*d*. Since the laser beam scanner units 31*a* to 31*d* in practice share a common arrangement and functions, the description below will focus on the arrangement and functions of the laser beam scanner unit 31*a*.

The laser beam scanner unit 31*a* includes a semiconductor laser element (not shown), a polygon mirror 32*a* as a guiding device, a fθ lens 33*a*, and mirrors 34*a*.

The semiconductor laser element shines a dot beam modulated according to input image data. The polygon mirror 32*a* guides the dot beam of the semiconductor laser element in a main scan direction. The fθ lens 33*a* converges the dot beam guided by the polygon mirror 32*a*. The mirror 34*a* focuses the dot beam converged by the fθ lens on the surface of the photosensitive drum 26*a*. By thus focusing the dot beam on the photosensitive drum 26*a*, an electrostatic latent image is formed on the surface of the photosensitive drum 26*a*.

In the laser beam scanner units 31*b* to 31*d*, the polygon mirrors 32*b* to 32*d* are equivalent to the polygon mirror 32*a*, the fθ lenses 33*b* to 33*d* to the fθ lens 33*a*, the mirrors 34*b* to 34*d* to the mirror 34*a*.

The image reader unit 3 supplies an image signal indicative of the black component image of the color original document image to the laser beam scanner unit 31*a*, an image signal indicative of the cyan component image of the color original document image to the laser beam scanner unit 31*b*, an image signal indicative of the magenta component image of the color original document image to the laser beam scanner unit 31*c*, and an image signal indicative of the yellow component image of the color original document image to the laser beam scanner unit 31*d*. Hence, electrostatic latent images are formed on the photosensitive drums 26*a* to 26*d* according to the color-converted input original document data.

The image forming unit 4 thus arranged reproduces toner images of the foregoing colors on the sheet P from the input image data converted in color by the image reader unit 3.

A series of image formation steps executed in the digital color copying machine 1 arranged as above will be explained. Cut-sheet like sheets P are used in the digital color copying machine 1. Each sheet P is sent out from the paper feeder cassette 13 and fed to a guide in the paper feeder transport path in the paper feeder mechanism 14. A sensor (not shown) detects a leading edge of the sheet P, as it is fed to the guide. The feeding movement of the sheet P is temporarily suspended by a pair of resist rollers 15 based on a detection signal output of the sensor. In this manner, the sheet P is transported at a suitable timing in relationship to the image formation stations 25*a* to 25*d* onto the transfer and transport belt 19 that is rotating in the direction indicated by arrow Z in FIG. 2.

Thereafter, the sheet P is electrostatic attracted to the transfer and transport belt 19 and transported to the image formation stations 25*a* to 25*d* where the toner images of the foregoing colors formed on the photosensitive drums 26*a* to 26*d* are transferred one on the other on the support surface of the sheet P. As the image formation station 25*d* completes the image transfer, the sheet P is guided to the fixer 20, and ejected onto the paper ejection tray 23.

Figure 1:
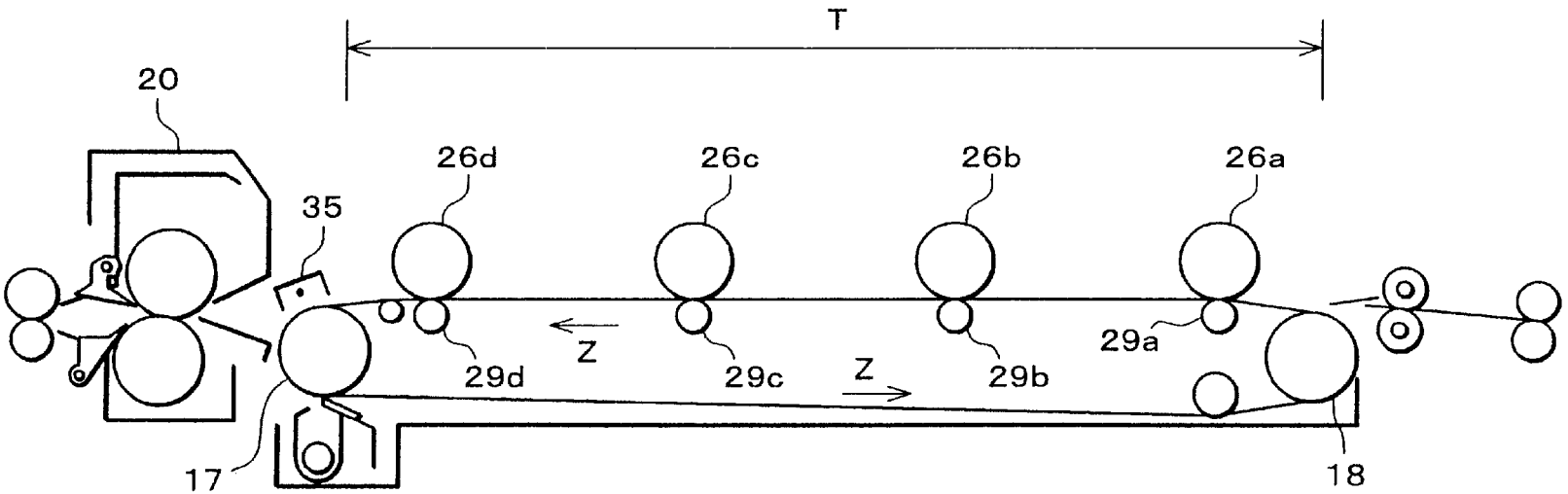
FIG. 1 is a drawing schematically showing an arrangement of an image forming device in accordance with the present invention in and around transfer areas.

Next, the transfer rollers 29*a* to 29*d* provided in the image formation stations 25*a* to 25*d* will be explained in detail. The transfer rollers 29*a* to 29*d* are provided as shown in FIG. 1, each for a different one of the photosensitive drums 26*a* to 26*d*. The drive roller 17 and the driven roller 18 of the transfer and transport belt 19 form between them an area where the toner images formed on the photosensitive drums 26*a* to 26*d* are transferred onto the sheet P by the transfer rollers 29*a* to 29*d*. Hereinafter, the area will be referred to as a transfer area T.

The transfer rollers 29*a* to 29*d* in the transfer area T have a crown shape. The transfer rollers 29*a* to 29*d* are fabricated with crown quantities (detailed later) that decrease in stages towards the downstream side along the transport direction of the sheet P indicated by arrow Z in FIG. 1.

Now, the "crown shape" of the transfer rollers 29*a* to 29*d* is explained, taking the transfer roller 29*a* as the exemplar of the four transfer rollers.

Figure 4:
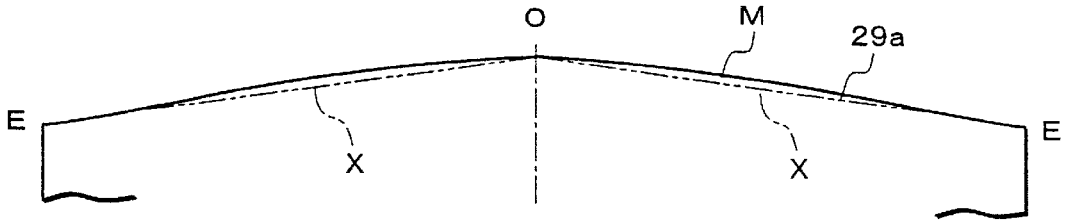
FIG. 4(*a*) is an explanatory drawing showing a crown shape of a transfer roller in the image forming device.
Figure 4:
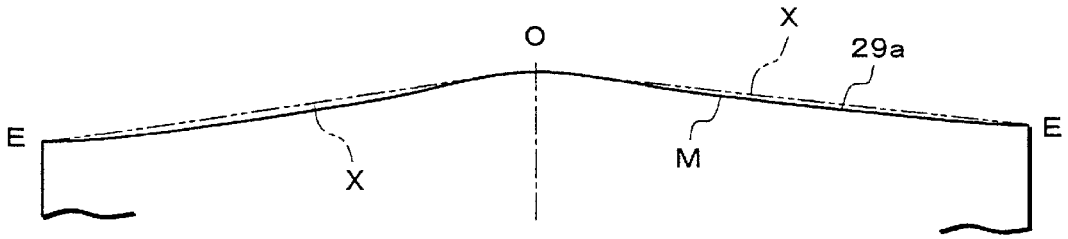

As shown in FIG. 4(*a*) and FIG. 4(*b*), the transfer roller 29*a* is fabricated in such a shape that the diameter of a cross section taken at right angles to the axis is smallest in the axial end portions and increases towards the axial midportion.

In the arrangement, since the transfer roller 29*a* is fabricated in a crown shape, the transfer pressure exerted by the transfer roller 29*a* on the image carrier can be prevented from decreasing in the axial midportion in the transfer position (press section where the transfer roller 29*a* presses the. image carrier). Therefore, the transfer pressure exerted on the transfer medium transported to the transfer position can be rendered substantially uniform over the entire length of the axis.

Therefore, even when the transfer medium absorbs moisture in a non-uniform manner, the transfer pressure can be rendered substantially equal in the axial midportions and in the axial end portions of the transfer roller 29*a*, effectively transferring the toner image to the sheet P.

Also, in the transfer position (nip section or press section where the transfer roller 29*a* presses the photosensitive drum 26*a*), the sheet P is stretched outwards from the axial midportion towards the axial end portions. Thus, the sheet P can be transported while being prevented from wrinkling in the axial end portions.

If the surface of the transfer roller 29*a* viewed along the axis is of such a crown shape that the curved line M represented by the surface of the transfer roller 29*a* in its cross-sectional view taken along the axis (FIG. 4(*b*)) is located closer to the axis than the segments X linking the end points E to the apex O which is the midpoint of the curved line M when viewed along the axis of the transfer roller 29*a*, the sheet P is not pressed against the surface of the transfer roller 29*a* uniformly and may flip in the axial end portions. This may be result in the toner image on the photosensitive drum 26*a* being transferred to the sheet P in only less-than-satisfactory conditions and partial whitening occurring in the transferred toner image.

In contrast, as shown in FIG. 4(*a*), it the transfer roller 29*a* has such a crown shape that the curved line M is located farther from the axis than the segments X, the transfer roller 29*a* can be caused to exert to the sheet P a transfer pressure that is more uniform on the surface of the transfer roller 29*a* along the axial direction. This allows well-balanced compression of the sheet P to the surface of the photosensitive drum 26*a* and enables better transfer of the toner image to the sheet P.

For these reasons, it is preferred if the transfer roller 29*a* is of such a crown shape as shown in FIG. 4(*a*).

The characteristics of the crown shape of the transfer roller 29*a* detailed above are applicable to the transfer rollers 29*b* to 29*d*.

As mentioned above, the transfer rollers 29*a* to 29*d* are fabricated so that the difference between the diameters of cross sections taken at right angles to the axis in the axial midportion and in the axial end portions, i.e., the crown quantity, decreases in stages towards the downstream side along the transport direction of the sheet P indicated by arrow Z in FIG. 1.

Figure 3A:
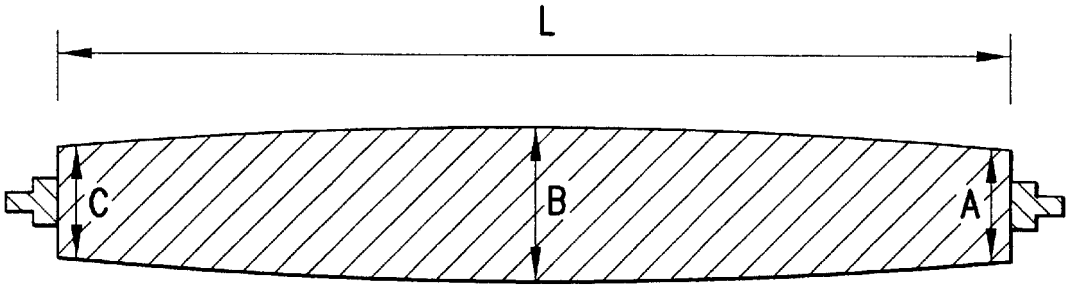
FIGS. 3A and 3B are cross-sectional views showing a crown shape of a transfer roller in the image forming device.
Figure 3B:
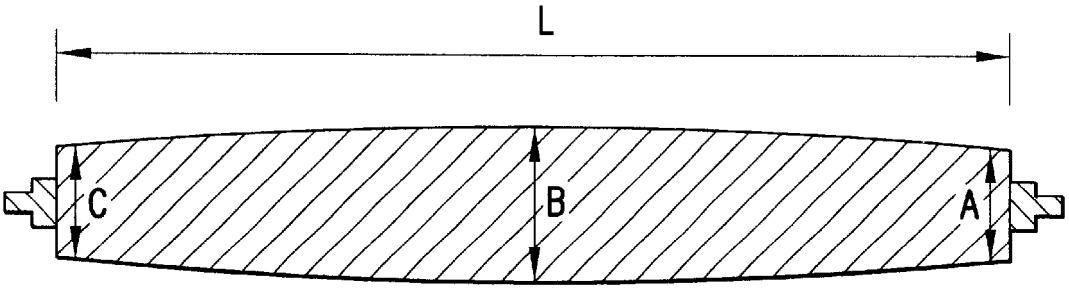

For example, supposing that the transfer roller 29*a* has a length L of 302 mm measured along the axis, diameter B of 14.40 mm measured in the axial midportion, and diameters A and C of 14.00 mm each measured in the axial end portions as shown in FIG. 3A, the crown quantity of the transfer roller 29*a* is obtainable from an equation, B-A or B-C, which equals 0.4 mm.

Under the foregoing conditions on the dimensions of the transfer roller 29*a*, the crown quantity is further specified to decrease in stages towards the downstream side along the transport direction of the sheet P: for example, the transfer roller 29*b* has a crown quantity of 0.3 mm, the transfer roller 29*c* has a crown quantity of 0.2 mm, and the transfer roller 29*d* has a crown quantity of 0.1 mm.

By making the transfer rollers 29*a* to 29*d* so that the crown quantity decreases in stages towards the downstream side along the transport direction of the sheet P in the above manner, the transfer pressure can be rendered equal in the axial midportion and in the axial end portions of each transfer roller 29*b* to 29*d* which are located downstream where the toner layer grows thicker on the sheet P. Hence, the toner image can be transferred to the sheet P in good conditions over the entire axial length of each transfer roller 29*b* to 29*d* located downstream.

Note that it is preferred if the transfer pressure exerted to the sheet P by the transfer roller 29*d* located most downstream along the transport direction of the sheet P is greater than the transfer pressures exerted to the sheet P by the transfer rollers 29*a* to 29*c* located upstream. When this is the case, the downstream transfer roller 29*d* with a small crown quantity can exert to the sheet P a transfer pressure that is more or less equal to the transfer pressures exerted to the sheet P by the upstream transfer rollers 29*a* to 29*c*, enabling the toner image formed on the photosensitive drum 26*d* to be transferred to the sheet P in good conditions.

The sheet P onto which the toner images have been thus transferred from the transfer rollers 29*a* to 29*d* in good conditions is guided to the fixer 20 where the toner images are fixed. Hence, the sheet P is ejected to the paper ejection tray 23, carrying on it a clear and vivid, well-fixed copy image with no partial whitening.

Incidentally, if the resultant toner image is principally composed of the toner image transferred from the photosensitive drum 26*a* to the sheet P, the transfer rollers 29*b* to 29*d*, located downstream to the transfer roller 29*a*, may be of such a crown shape that the crown quantity equals 0, i.e., of a straight shape wherein the diameter in the axial midportion and the diameters in the axial end portions are all equal.

This enables the toner images to be fixed to the sheet P with more uniform transfer pressure in the axial midportions and in the axial end portions of the transfer rollers 29*b* to 29*d*. Therefore, the toner images can be formed on the sheet P in better conditions.

Especially, if the transfer roller 29*d*, located most downstream along the transport direction of the sheet P, is of a straight shape, the sheet P can be prevented from flipping in the axial end portions as it leaves the transfer area T and moves to the fixer 20. This prevents the fixer 20 from poorly fixing the toner image in the axial end portions of the sheet P.

As detailed so far, the transfer rollers 29*a* to 29*d* thus arranged and provided in the digital color copying machine 1 are capable of applying a higher transfer pressure to the photosensitive drums 26*a* to 26*d* in their axial midportions; therefore, the transfer pressure applied on the transfer medium transported to the transfer position can be rendered substantially equal in the axial midportion and in the axial end portions of each transfer rollers 29*a* to 29*d*.

Also, in the transfer position (press section where the transfer rollers 29*a* to 29*d* press the photosensitive drums 26*a* to 26*d*), the sheet P is stretched outwards from the axial midportion towards the axial end portions. Thus, the sheet P can be transported while being prevented from wrinkling in the axial end portions.

Further, the transfer rollers 29*a* to 29*d* are fabricated in such a crown shape that their crown quantities decrease in stages towards the downstream side along the transport direction of the sheet P. Thereby, the transfer pressure can be rendered equal in the axial midportion and in the axial end portions of each transfer roller 29*b* to 29*d* which are located downstream where the toner layer grows thicker on the sheet P. Hence, the toner image can be transferred to the transfer medium in good conditions over the entire axial length of each transfer roller 29*b* to 29*d* located downstream.

As detailed so far, the transfer rollers 29*a* to 29*d* thus arranged enables the sheet P to be transported, while prevented the sheet P from wrinkling in the axial end portions in the nip section between the photosensitive drums 26*a* to 26*d* and the transfer rollers 29*a* to 29*d*, and also enables good transfer conditions to be achieved at the transfer rollers 29*b* to 29*d* located downstream.

Hence, a clear and vivid, well-fixed copy image can be formed on the sheet P with no partial whitening.

Alternatively, an image forming device in accordance with the present invention may be such that it includes:

- image carriers provided parallel to each other in a transfer area where toner images are transferred to a transfer medium; and
- transfer rollers, each being associated to a different one of the image carriers and having a surface made of elastic material, for transferring toner images carried by the image carriers to the transfer medium, wherein:

- the transfer roller(s) located in the upstream side of the transfer area where the toner images are transferred to the transfer medium is(are) fabricated in a crown-like shape; and
- the transfer roller(s) located in the downstream side is(are) of a near straight shape.

With the arrangement, at the transfer roller(s) located in the upstream side of the transfer area, the transfer medium is transported while being stretched from the axial midportion towards the axial end portions, effectively transferring the toner image(s) to the recording medium. Also, at the transfer roller(s) located in the downstream side of the transfer area, the toner image(s) can be transferred by the transfer pressure that is applied uniformly on the recording medium before the fixer fixes the toner image(s); therefore the recording medium can be prevented from flipping upon ejection, and partial whitening, as well as poor transfer and fixing, becomes preventable even under a highly humid environment.

Another image forming device in accordance with the present invention may be arranged identically to the aforementioned image forming device and further arranged so that the transfer rollers provided parallel to each other in the transfer area are of such a crown shape that the crown quantities decrease gradually from the upstream towards the downstream side of the transfer area.

With the arrangement, the difference between the transfer pressures on the recording medium in the axial midportion and in the axial end portions of each transfer roller is caused to decrease as the toner layer grows thicker on the recording medium; thereby, a toner image can be transferred in good conditions onto another toner image which is already transferred.

Another image forming device in accordance with the present invention may be arranged identically to the aforementioned image forming device and further arranged so that each transfer roller is of such a crown shape that its surface between the axial midportion and the axial end portions is located farther from the straight lines linking the axial midpoint to the axial end portions.

With the arrangement, the transfer pressure can be applied to the transfer medium highly uniformly over the entire axial length without causing an insufficient transfer pressure between the axial midportion and the axial end portions of each transfer roller, enabling satisfactory transfer free from partial whitening and other defects.

Another image forming device in accordance with the present invention may be arranged identically to the aforementioned image forming device and further arranged so that the surface of the transfer rollers of a crown shape has a hardness ranging from 28 degrees to 30 degrees in Asker C.

With the arrangement the transfer roller of a crown shape can apply a transfer pressure to the transfer medium in more stable conditions in the axial direction, enabling satisfactory transfer free from partial whitening and other defects.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming device, comprises:

image carriers provided parallel to each other in a transfer area where toner images are transferred to a transfer medium; and transfer rollers, each being associated to a different one of the image carriers, for pressing and thus transferring the toner images carried by the image carriers to the transfer medium, wherein:

each of the transfer rollers is fabricated in a crown shape and so that a difference between diameters of cross sections taken at right angles to an axis in an axial midportion and in axial end portions decreases in stages towards a downstream side along a transport direction of the transfer medium.

2. The image forming device as defined in claim 1, wherein:

each of the transfer rollers is fabricated so that a curved line represented by a surface of the transfer roller in a cross-sectional view taken along an axis is located farther from the axis than segments linking two end points to an apex which is a midpoint of the curved line when viewed along the axis of the transfer roller.

3. The image forming device as defined in claim 1, wherein:

one of the transfer rollers which is located most downstream along the transport direction of the transfer medium is fabricated so that a diameter of a cross section taken at right angles to the axis is uniform over an entire axial length.

4. The image forming device as defined in claim 1, wherein:

one of the transfer rollers which is located most downstream along the transport direction of the transfer medium exerts a greater transfer pressure than do the remaining transfer rollers which are located upstream thereto.

5. The image forming device as defined in claim 1, wherein:

each of the transfer rollers of a crown shape is fabricated with a surface hardness ranging from 28 degrees to 30 degrees in Asker C.

6. An image forming device comprising:

image carriers provided parallel to each other in a transfer area where toner images are transferred to a transfer medium; and transfer rollers, each being associated to a different one of the image carriers, for pressing and thus transferring the toner images carried by the image carriers to the transfer medium, wherein:

each of the transfer rollers is fabricated in a crown shape; and each of the transfer rollers, except for the one which is located most upstream along a transport direction of the transfer medium, is fabricated so that a diameter of a cross section taken at right angles to an axis is uniform over an entire axial length.

7. An image forming device, comprising:

image carriers provided parallel to each other in a transfer area where toner images are transferred to a transfer medium; and transfer rollers, each being associated with a different one of the image carriers, for pressing and thus transferring the toner images carried by the image carriers to the transfer medium, wherein:

each of the transfer rollers is fabricated in such a shape that diameters of cross sections taken at right angles to an axis increase from axial end portions toward an axial midportion so that a difference between the diameters in the axial midportion and in the axial end portions decreases in stages toward a downstream side along a transport direction of the transfer medium.

* * * * *